US008343705B2

(12) United States Patent
Tomioka et al.

(10) Patent No.: US 8,343,705 B2
(45) Date of Patent: Jan. 1, 2013

(54) METHOD OF MANUFACTURING TONER, TONER, SCREENING DEVICE, AND METHOD OF RECYCLING TONER

(75) Inventors: Yasuaki Tomioka, Iwanuma (JP); Yousuke Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 342 days.

(21) Appl. No.: 12/618,856

(22) Filed: Nov. 16, 2009

(65) Prior Publication Data

US 2010/0124716 A1 May 20, 2010

(30) Foreign Application Priority Data

Nov. 17, 2008 (JP) ..... 2008-293677

(51) Int. Cl.
*G03G 9/08* (2006.01)

(52) U.S. Cl. ..... 430/137.2; 430/137.1

(58) Field of Classification Search ..... 130/137.1, 130/137.2

See application file for complete search history.

(56) References Cited

U.S. PATENT DOCUMENTS

| | | | | |
|---|---|---|---|---|
| 5,653,346 | A * | 8/1997 | Frei et al. | 209/254 |
| 5,846,683 | A * | 12/1998 | Murakami et al. | 430/137.21 |
| 2004/0175643 | A1* | 9/2004 | Baba et al. | 430/109.4 |
| 2005/0158643 | A1* | 7/2005 | Yamaguchi et al. | 430/105 |
| 2007/0160926 | A1* | 7/2007 | Ayaki et al. | 430/137.15 |

FOREIGN PATENT DOCUMENTS

| | | |
|---|---|---|
| JP | 2000-75547 | 3/2000 |
| JP | 2008-76873 | 4/2008 |

* cited by examiner

*Primary Examiner* — Peter Vajda
(74) *Attorney, Agent, or Firm* — Cooper & Dunham LLP

(57) ABSTRACT

A method of manufacturing a toner including manufacturing a coarse toner containing a binder resin and a coloring agent, and screening the coarse toner with a screen device including a top screen having an opening of from 26 to 43 μm and a bottom screen situated below the top screen having an opening of from 54 to 150 μm to screen the coarse toner with the top screen by ultrasonic vibration and mechanical vibration at 50° C. or lower, and with the bottom screen by mechanical vibration at 35° C. or lower.

8 Claims, 1 Drawing Sheet

METHOD OF MANUFACTURING TONER, TONER, SCREENING DEVICE, AND METHOD OF RECYCLING TONER

BACKGROUND OF THE INVENTION

1. Field of the Invention

The present invention relates to a method of manufacturing toner, the toner, and a method of recycling the toner.

2. Discussion of the Background

Methods of visualizing image information by forming electrostatic images according to electrophotography are utilized in various kinds of fields now In the electrophotography, latent images are formed on an image bearing member through the charging and irradiation processes and developed with a development agent containing toner to visualize the images. Thereafter, the visualized images are transferred to and fixed on a recording medium.

The development agent is typified into a two component development agent containing toner and carrier, and a single component development agent in which magnetic toner or non-magnetic toner is singly used. Toner is the main component in both development agents.

Recently, toner having a small particle diameter has been dominant because such toner is advantageous in terms of image quality. Toner is manufactured by a known method such as a dry method using pulverization, an emulsification polymerization agglomeration method, a suspension polymerization method, a drying-in-liquid method, and a phase transfer emulsification method. In pulverization, toner having a desired particle diameter is obtained by: uniformly mixing and dispersing material such as a binder resin, a releasing agent, a coloring agent and an optional charge control agent with a pressure kneader, an extruder, or a medium disperser; pulverizing the mixture by mechanical collision or collision in jet air with a target to obtain toner particles; and classifying the toner particles to obtain toner having a sharp particle size distribution.

The toner for use in electrophotography is typically formed of a binder resin, a coloring agent, and other optional material. Inorganic particulates are externally added and admixed with the toner to improve fluidity of the toner in most cases. Toner to which inorganic particulates are externally added has sufficient fluidity and is suitable to obtain quality images with no white spots.

However, the toner particles and the external additives are agglomerated by heat generation due to high speed stirring and collision of particles in the process of admixing and string toner particles and external additives, which may result in formation of agglomerated toner particles.

In addition, there are problems specific to the wet manufacturing methods, which are agglomerated particles formed in the processes of emulsification, suspension, drying, etc., and coarse particles having a board form ascribable to material fixated on a container or vessel for emulsification, suspension, reaction, etc., and stirring wings, etc.

Such coarse particles tend to have an adverse impact on the image quality. For example, the distance (i.e., the gap) between the photoreceptor and a transfer medium in the transfer process in image formation is caused to be non-uniform by these coarse particles. Also, such coarse particles easily scatter to non-image portions. Furthermore, the difference in the charge of amount among particles arises due to the difference in the particle diameter among particles, which causes uneven image density.

In addition, such coarse toner particles tend to scatter during development and resultantly contaminate inside the image forming apparatus, which leads to degradation of the reliability of the image forming apparatus.

The problem common in the drying method and the wet method is that agglomerated body or coarse toner particles produced in the toner manufacturing process cause production of abnormal images. Thus, methods of removing such agglomerated bodies and/or coarse toner particles in the screening process have been studied and provided.

For example, unexamined published Japanese patent application No. (hereinafter referred to as JOP) 2000-75547 describes a screening process defining the relationship between the temperature of the screen and the temperature of the toner, and the amount of toner supplied to the screen.

JOP 2008-76873 describes a screening method by using a two step screen with definitions for the opening and void ratio thereof.

As described above, various kinds of methods of removing the agglomerated bodies and/or coarse particles formed before the screening process have been studied.

Furthermore, a method of using an ultrasonic screen is used as an economic method of manufacturing toner having a desired particle diameter.

On the other hand, toner is spurred to have a low melting point to deal with full color images and increase the speed of performance. Thus, because of heat generated by ultrasonic vibration to the screen, toner particles easily melt and attach to each other in the screening process, which leads to formation of softly agglomerated particles and commingling thereof into toner products.

Toner having a low melting point that is confirmed to have no agglomerated bodies immediately after the screening process may agglomerate during preservation depending on the preservation condition such as temperature.

Such softly agglomerated toner causes the trouble described above in image formation. Particularly, white spots are formed while having such agglomerated bodies as a core, which results in degradation of the image quality.

SUMMARY OF THE INVENTION

Because of these reasons, the present inventors recognize that a need exists for a method of manufacturing toner that produces less agglomerated toner particles and forms quality images, the toner manufactured by this method, and a recycling method of the toner.

Accordingly, an object of the present invention is to provide a method of manufacturing toner that produces less agglomerated toner particles and forms quality images, the toner manufactured by this method, and a recycling method of the toner.

Briefly this object and other objects of the present invention as hereinafter described will become more readily apparent and can be attained, either individually or in combination thereof, by a method of manufacturing a toner including manufacturing a coarse toner containing a binder resin and a coloring agent; and screening the coarse toner with a screen device including a top screen having an opening of from 26 to 43 μm and a bottom screen situated below the top screen having an opening of from 54 to 150 μm to screen the coarse toner with the top screen by ultrasonic vibration and mechanical vibration at 50° C. or lower, and with the bottom screen by mechanical vibration at 35° C. or lower.

It is preferred that, in the method of manufacturing a toner mentioned above, the top screen includes a sympathetic vibrator that sympathetically vibrates to the ultrasonic vibration.

As another aspect of the present invention, a toner is provided which contains a binder resin containing a block copolymer of a polyester and a polyolefin and a coloring agent, wherein the toner is manufactured by the method of manufacturing a toner mentioned above.

It is preferred that the toner mentioned above further contains a releasing agent.

As another aspect of the present invention, a screening device is provided which includes a top screen having an opening of from 26 to 43 μm to screen the toner by using ultrasonic vibration and mechanical vibration, and a bottom screen having an opening of from 54 to 150 μm to screen the toner screened by the top screen by using mechanical vibration.

It is preferred that, in the screening device mentioned above, the top screen includes a sympathetic vibrator that sympathetically vibrates to the ultrasonic vibration.

As another aspect of the present invention, a method of recycling a toner is provided which includes screening the toner containing a binder resin, and a coloring agent with a screen device including a top screen having an opening of from 26 to 43 μm and a bottom screen situated below the top screen having an opening of from 54 to 150 μm to screen the toner with the top screen by ultrasonic vibration and mechanical vibration, and the toner screened by the top screen with the bottom screen by mechanical vibration It is preferred that, in the method of recycling a toner, the top screen has a sympathetic vibrator that sympathetically vibrates to the ultrasonic vibration.

It is still further preferred that, in the method of recycling a toner, the top screen screens the toner at 50° C. or lower, and the bottom screen screens the toner at 35° C. or lower.

It is still further preferred that, in the method of recycling a toner, the one side amplitude in the ultrasonic vibration is from 3 to 8 μm.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
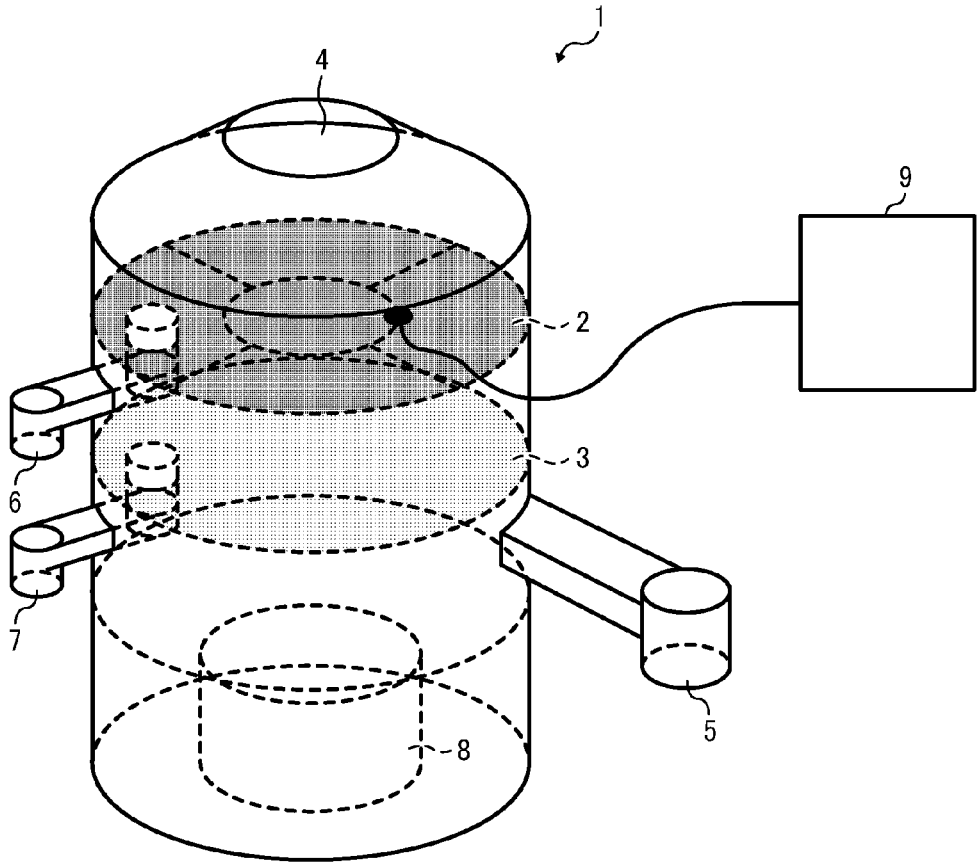
FIG. 1 is a schematic diagram illustrating an example of the screen device for use in the present invention.

The present invention will be described below in detail with reference to several embodiments and accompanying drawings.

The method of manufacturing a toner of the present invention includes a process of manufacturing a coarse toner containing a binder resin and a coloring agent, and a process of screening the coarse toner with a screen device. The screen device has two screens of a top screen and a bottom screen situated below the top screen (refer to an example illustrated in FIG. 1). The top screen has an opening of from 26 to 43 μm and screens the coarse toner by ultrasonic vibration and mechanical vibration, and the bottom screen has an opening of from 54 to 150 μm and screens the toner screened by the top screen by mechanical vibration. Typically, the opening of the screen for powder classification situated on the upstream side is greater than that of the screen situated on the downstream side. However, the screen device for use in the present invention is the contrary. The top screen has a structure of screening toner by ultrasonic vibration in addition to mechanical vibration while the bottom screen mechanically screens it. The top screen has an opening of from 26 to 43 μm but efficiently separate foreign material and coarse particles in the toner due to the ultrasonic vibration and mechanical vibration. In addition, the screen device loosens agglomeration of relatively softly agglomerated toner particles to obtain desired particles. The top screen having an opening outside the range specified above tends to have low productivity since coarse toner particles stay on the top screen, or pass coarse particles or agglomerated particles without pulverization or separation.

An ultrasonic-vibrated screen generates heat. No problem arises when toner is classified in a short time on such an ultrasonic vibrated screen because the toner drops absorbing the heat. When the top screen continuously vibrates by ultrasonic for a long time, the temperature of the screen phase rises by transferred heat, thereby softening the toner or oozing the releasing agent and/or binder resin melted in the toner to the surface thereof. As a result, the heated toner particles agglomerate and attach to the screen phase.

However, the top screen provides ultrasonic vibration and mechanical vibration so that weakly or softly agglomerated toner particles or toner particles attached to the screen phase are forcibly broken or detached and thus drop to the bottom screen.

Thus, the toner that is heated to a high temperature and thus easily agglomerates possibly agglomerates after passing through the top screen.

Then, the bottom screen having a relatively rough opening size, i.e., 54 to 150 μm, loosens agglomeration of the softly agglomerated toner that has dropped from the top screen or prevents re-agglomeration of toner by relatively gentle mechanical vibration. Thereafter, the toner particles are cooled down by air while staying on the bottom screen and hardly agglomerate. The toner particles that have been cooled down and thus hardly agglomerate pass the bottom screen to obtain toner products. This toner is free from concern about re-agglomeration as long as the toner is properly preserved in a container, etc.

A bottom screen that has an opening of from 54 to 150 μm is suitable to cause toner to stay on the bottom screen and be cooled down, thereby preventing agglomeration of toner particles. A bottom screen having an opening that is too small tends to cause the staying time on the bottom screen too long, which leads to an adverse impact in terms of productivity.

By contrast, a bottom screen having an opening that is too large tends to cause the staying time of the toner particles on the bottom screen too short so that the toner particles are not sufficiently cooled down and thus the toner particles easily agglomerate after the bottom screen.

A specific optimal opening size of the bottom screen is preferably adjusted considering the toner form, the heating temperature for the toner particles on the top screen, etc.

The top screen of the screen device for use in the present invention preferably has a sympathetic vibrator that sympathetically vibrates to ultrasonic vibration.

Figure 2:
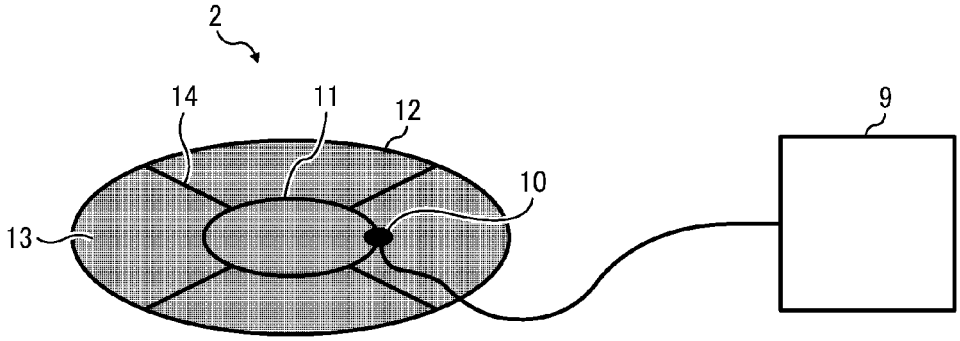
FIG. 2 is a schematic diagram illustrating the top screen of the screen device illustrated in FIG. 1.

To be specific, a vibration ring 11 situated on a net 13 of a top screen 2 is used as the sympathetic vibrator (refer to FIG. 2).

The vibration ring 11 is supported by a net outer frame 12 and a reinforcing crosspiece 14, and sympathetically vibrates to ultrasonic vibration provided by an ultrasonic oscillator attached to the vibration ring 11. Thus, the entire of a net 13 is stably vibrated by ultrasonic vibration.

The temperature of the screen of the screen device during the screening process is preferably 50° C. or lower for the top screen, and 35° C. or lower for the bottom screen.

Typically, raw material coarse toner that is introduced into the screen device is at about room temperature (10 to 25° C.), but the top screen generates heat according to ultrasonic vibration provided thereto.

As described above, the heated screen transfers the heat to toner particles, which produces heat by vibration friction.

When the toner particles produce heat and the temperature thereof rises to an excessively high temperature, the releasing agent, the binder resin contained in the toner particles are softened or melted, which leads to formation of agglomerated bodies.

In the screen device for use in the present invention, toner particles are cooled down on the bottom screen to loosen or prevent agglomeration. However, when the top screen is heated to 50° C. or higher, or the bottom screen is heated to 35° C. or higher, the temperature of the toner particles rises accordingly. Therefore, depending on the toner form or preservation situation, agglomerated toner particles may be mingled into toner products, or toner products may agglomerate during preservation.

To prevent such commingling of agglomerated toner particles or agglomeration of toner particles in toner products, the temperature of the screens are preferably kept within the range specified above.

The screen device is typically used in a room temperature environment and thus the temperature of the screen does not fall under the room temperature. Thus, there is no need to limit the lowest temperature.

The intensity of the ultrasonic vibration on the top screen of the screen device is preferably of from 3 to 8 μm on one side amplitude.

As described above, it is desirable that the intensity of the ultrasonic vibration be 8 μm or smaller on one side amplitude to maintain the temperature of the screen during the screening process below the specified value.

When the intensity is excessively strong, the screen tends to produce excessive heat.

By contrast, when the intensity of the ultrasonic vibration is excessively weak on one side amplitude, the screening speed tends to decline, which leads to a drop of productivity.

When toner particles stay on the top screen for an excessively long time, the amount of heat transferred from the top screen to the toner particles increases and in addition, the toner particles are heated and easily agglomerate due to friction among the toner particles by ultrasonic vibration.

Furthermore, the bottom screen is also heated by the toner particles and the temperature thereof may rise.

Toner that contains a binder resin, a coloring agent and other optional agents such as a releasing agent is well known.

The toner of the present invention contains a binder resin, a coloring agent, and preferably a releasing agent. The binder resin preferably contains a block copolymer of a polyolefin and a polyester.

Polyesters are well known as a binder resin but polyesters tend to have insufficient affinity with a releasing agent such as wax.

When the binder resin and the releasing agent have a different or insufficient affinity, the releasing agent is not sufficiently dispersed inside the toner particles, or the releasing agent that has been once dispersed inside the toner particles tends to ooze to the surface thereof when the temperature of the toner particles rises.

The screen device using ultrasonic vibration is used to manufacture the toner of the present invention and thus the toner particles are possibly heated.

Since some releasing agents are softened or melted at around 50° C., the releasing agent in the heated toner particles is melted and easily oozes to the surface thereof. When the releasing agent oozes to the surface of the toner particles, the toner particles agglomerate or attach to the screen and stay thereon, which leads to a drop of productivity. Finally, all over the surface of the screen is covered with such toner particles, which makes it impossible to conduct screening of the toner particles.

However, when the binder resin contains a block copolymer of a polyolefin and a polyester, such ooze of the releasing agent to the surface of the toner particles can be prevented because the polyolefin portion in the binder resin that has a strong affinity with the releasing agent such as wax tends to physically absorb the releasing agent, On the other hand, the polyester portion in the binder resin still maintains the same excellent functions of dispersing the coloring agent, fixing toner images, etc., as a typical polyester based binder resin.

The toner of the present invention has the composition described above and is subject to the screening treatment (method) described above in detail.

Therefore, since the toner of the present invention has few agglomerated bodies and hardly agglomerates during preservation, quality images are produced when the toner is used in an image formation device employing electrophotography. In addition, the toner of the present invention has no need for a concern about the preservation environment or pulverization treatment for softly agglomerated bodies after preservation The toner of the present invention preferably has a ratio of the toner remaining on the sieve of 0.5 mg/g at maximum when screened by a sieve having 200 meshes (linear diameter: 50 μm, opening: 75 μm).

The toner remaining on the screen is thought to be agglomerated toner.

When the toner manufactured by the method of manufacturing toner described above is screened with the sieve having 200 meshes, the ratio of the toner remaining on the sieve is typically 0.5 mg/g at maximum. However, the ratio may surpass this upper limit depending on the preservation environment.

When toner having an excessively high ratio of the toner remaining on the sieve is used to form an electrophotographic image, the obtained image may have white spots (no colored portion) on the image.

Therefore, it is desirable to use a toner having a ratio of toner remaining on the sieve of 0.5 mg/g at maximum to prevent such image quality deterioration. In addition, toner containing such agglomerated toner in a large amount can be recycled by the method of recycling toner containing agglomerated toner described above.

The screening device for use in the present invention has two screens including a top screen and a bottom screen. The top screen has an opening of from 26 to 43 μm, and conducts ultrasonic vibration and mechanical vibration, and the bottom screen has an opening of from 54 to 150 μm, The top screen preferably has a sympathetic vibrator that sympathetically vibrates to ultrasonic vibration.

The screen device is suitable to manufacture the toner of the present invention as described above. Particularly, the screen device having a sympathetic vibrator as illustrated in FIGS. 1 and 2 is preferable for the method of manufacturing toner of the present invention.

The method of recycling toner of the present invention uses the screening process in the method of manufacturing toner of the present invention as describe above. The method of recycling toner of the present invention is applied to toner part of which agglomerates in an environment of a high temperature and high humidity or an unsuitable preservation environment in which the toner is under excessive load.

The method of recycling toner of the present invention is a method of manufacturing toner products from toner that has agglomerated and thus is unsuitable as a product.

The method of recycling toner of the present invention is a method of recycling toner part of which is agglomerated and includes a process of screening the agglomerated toner containing at least a binder resin and a coloring agent with a screen device including a top screen and a bottom screen. The top screen has an opening of from 26 to 43 μm, and screens toner by ultrasonic vibration and mechanical vibration, and the bottom screen has an opening of from 54 to 150 μm and screens toner by mechanical vibration The top screen preferably has a sympathetic vibrator that sympathetically vibrates to the ultrasonic vibration.

Quality toner is efficiently recycled by the method of recycling toner of the present invention by setting an amplitude of the ultrasonic vibration on a one side of from 3 to 8 μm and a temperature at 50° C. or lower for the top screen, and a temperature at 35° C. or lower for the bottom screen.

In addition, the method of recycling toner of the present invention is easily conducted by the screen device described above.

Method of Manufacturing Coarse Toner

The wet method of manufacturing coarse toner for use in the present invention is described. The coarse toner represents toner obtained prior to screening by the screen device for use in the screen process in the method of manufacturing toner of the present invention. Coarse toner is manufactured by: mixing in an aqueous medium an organic solvent composition containing a binder resin, a coloring agent, and optionally a releasing agent, or a polymerizable monomer composition containing a polymerizable monomer, a coloring agent, and optionally a releasing agent, in an organic solvent; applying a shearing force in the liquid mixture to obtain an emulsion or suspension; removing the organic solvent followed by washing and drying; and admixing the resultant with an external additive. The toner of the present invention is manufactured from this coarse toner through the next process, i.e., screening process, in which unnecessary agglomerated bodies, coarse particles, etc., are removed. Material for use in manufacturing coarse toner is described next.

Binder Resin

Polyester resins are suitable as the binder resin for use in the embodiment of the present invention. Typically, polyester resins are obtained by condensation polymerization of an alcohol and a carboxylic acid. Specific examples of such alcohols include, but are not limited to, glycols such as ethylene glycol, diethylene glycol, triethylene glycol, and propylene glycol, 1,4-bis(hydroxymethyl)cyclohexane, etherified bisphenols such as bisphenol A, diol monomers, tri- or higher polyol monomers.

Specific examples of carboxylic acids include, but are not limited to, two-valent organic acid monomers such as maleic acid, fumaric acid, phthalic acid, succinic acid, and moronic acid; and tri- or higher carboxylic acid monomers such as 1,2,4-benzene tricarboxylic acid, 1,2,5-benzene tricarboxylic acid, 1,2,4-cyclohexane tricarboxylic acid, 1,2,4-naphthalene tricarboxylic acid, 1,2,5-hexane tricarboxylic acid, 1,3-dicarboxyl-2-methylene carboxy propane, and 1,2,7,8-octane tetracarboxylic acid. A specific preferable polyester resin is a block copolymer of a polyolefin and a polyester. The polyesters specified above are used in the embodiment, and polyethylene, polypropylene and polybutane are used as the polyolefin. The polyester portion of the block copolymer of a polyolefin and a polyester has a strong affinity for the coloring agent, etc., and the polyolefin portion thereof has a strong affinity for the releasing agent such as wax. Therefore, such a block copolymer is suitable in terms that the releasing agent is dispersed inside the toner particles and ooze of the wax to the surface of the toner particles is prevented. In addition, this block copolymer can be manufactured by a significantly same method and handling as in the method of manufacturing a typical polyester resin, and the handling thereof, which is advantageous.

Specific examples of the binder resins for use in the present invention include, but are not limited to, in addition to the polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylate resins, rosin, modified rosins, terpene resins, aliphatic or alicyclic hydrocarbon resins, aromatic petroleum resins, chlorinated paraffin, paraffin waxes, etc. These resins can be used alone or in combination.

Specific examples of the polymerizable monomers for use in the present invention include, but are not limited to, aromatic vinyl monomers such as styrene, α-styrene, p-styrene, and p-styrene, unsaturated nitriles such as acrylonitrile, unsaturated (meth)acrylates such as methyl(meth)acrylate, ethyl(meth)acrylate, butyl(meth)acrylate, ethylhexyl(meth) acrylate, lauryl(meth)acrylate, and stearyl(meth)acrylate, and conjugated diolefines such as butadiene, and isoplene.

These polymerizable monomers are used alone or in combination.

The method of manufacturing coarse toner in this embodiment preferably includes a polymerization process of reacting a polyester based prepolymer having an isocyanate group dispersed in an aqueous medium containing inorganic particulates and/or polymer particulates with an amine.

A preferable prepolymer for use in this embodiment is a polyester prepolymer having an isocyanate group, which can be prepared by, for example, reacting a polyester having an active hydrogen group, which is a polycondensation product of a polyol (PO) and a polycarboxylic acid (PC), with a polyisocyanate (PIC).

Specific examples of the active hydrogen groups contained in the polyester include, but are not limited to, hydroxyl groups (alcohol hydroxyl groups and phenol hydroxyl groups), amino groups, carboxylic groups, and mercapto groups. Among these, alcohol hydroxyl groups are preferable.

Suitable polyols (PO) include, for example, diols (DIO) and polyols (TO) having three or more hydroxyl groups. Among these, a simple diol (DIO) or a mixture in which a small amount of a polyol (TO) is mixed with a diol (DIO) is preferable.

Specific examples of the diols include, but are not limited to, alkylene glycols (e.g., ethylene glycol, 1,2-propylene glycol, 1,3-propylene glycol, 1,4-butane diol, and 1,6-hexane diol); alkylene ether glycols (e.g., diethylene glycol, triethylene glycol, dipropylene glycol, polyethylene glycol, polypropylene glycol, and polytetra methylene ether glycol); alicyclic diols (e.g., 1,4-cyclohexane dimethanol, and hydrogen added bisphenol A); bisphenols (e.g., bisphenol A, bisphenol F and bisphenol S); adducts of the alicyclic diols mentioned above with an alkylene oxide (ethylene oxide, propylene oxide and butylenes oxide); and adducts of the bisphenols mentioned above with an alkylene oxide (ethylene oxide, propylene oxide and butylenes oxide).

Among these compounds, alkylene glycols having 2 to 12 carbon atoms and adducts of a bisphenol with an alkylene oxide are preferable. Adducts of bisphenol with an alkylene oxide and mixtures of an adduct of a bisphenol with an alkylene oxide and an alkylene glycol having 2 to 12 carbon atoms are particularly preferable.

Specific examples of the polyols (TO) having three or more hydroxyl groups include, but are not limited to, glycerin, trimethylol ethane, trimethylol propane, pentaerythritol and sorbitol); polyphenols having three or more hydroxyl groups (trisphenol PA, phenol novolak and cresol novolak); and adducts of the polyphenols having three or more hydroxyl groups mentioned above with an alkylene oxide.

Specific examples of polycarboxylic acids (PC) include, but are not limited to, dicarboxylic acids (DIC) and polycarboxylic acids (TC) having three or more hydroxyl groups. Among these, a simple dicarboxylic acid (DIC) or a mixture in which a small amount of a polycarboxylic acid (TC) is mixed with a dicarboxylic acid (DIO) is preferable.

Specific examples of the dicarboxylic acids (DIC) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc.

Among these compounds, alkenylene dicarboxylic acids having 4 to 20 carbon atoms and aromatic dicarboxylic acids having 8 to 20 carbon atoms are preferably used.

Specific examples of the polycarboxylic acids (TC) having three or more hydroxyl groups include, but are not limited to, aromatic polycarboxylic acids having 9 to 20 carbon atoms (e.g., trimellitic acid and pyromellitic acid).

As the polycarboxylic acid (PC), anhydrides or lower alkyl esters (e.g., methyl esters, ethyl esters or isopropyl esters) of the polycarboxylic acids mentioned above can be used for the reaction with a polyol (PO).

The suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with a phenol derivative, oxime or caprolactam; etc. These compounds can be used alone or in combination. A suitable mixing ratio (i.e., [NCO]/[OH]) of a polyisocyanate (PIC) to a polyester resin (PE) having a hydroxyl group to obtain a polyester prepolymer having an isocyanate group is from 5/1 to 1/1, preferably from 4/1 to 1.2/1 and more preferably from 2.5/1 to 1.5/1. The content ratio of the constitutional component of a polyisocyanate (PIC) in the polyester prepolymer having an isocyanate group at its end portion is from 0.5 to 40% by weight, preferably from 1 to 30% by weight, and more preferably from 2 to 20% by weight.

Polyamines and/or amines having an active hydrogen group are used as the amine. The active hydrogen group includes hydroxyl group and mercapto group.

Specific examples of the amines include, but are not limited to, diamines (B1), polyamines (B2) having three or more amino groups, amino alcohols (B3), amino mercaptans (B4), amino acids (B5), and blocked amines (B6) in which the amines (B1-B5) mentioned above are blocked.

Specific examples of the diamines (B1) include, but are not limited to, aromatic diamines (e.g., phenylene diamine, diethyltoluene diamine, and 4,4'-diaminodiphenyl methane); alicyclic diamines (e.g., 4,4'-diamino-3,3'-dimethyldicyclohexyl methane, diaminocyclohexane and isophorone diamine); aliphatic diamines (e.g., ethylene diamine, tetramethylene diamine, and hexamethylene diamine); etc.

Specific examples of the polyamines (B2) having three or more amino groups include, but are not limited to, diethylene triamine, and triethylene tetramine.

Specific examples of the amino alcohols (B3) include, but are not limited to, ethanol amine and hydroxyethyl aniline.

Specific examples of the amino mercaptan (B4) include, but are not limited to, aminoethyl mercaptan and aminopropyl mercaptan.

Specific examples of the amino acids (B5) include, but are not limited to, amino propionic acid and amino caproic acid.

Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc. Diamines (B1), and mixtures in which a small amount of a polyamine (B2) is mixed with a diamine (B1) are preferred.

The molecular weight of the polyester can be controlled by optionally using a molecular-weight control agent when the prepolymer reacts with the amine.

Specific examples of the molecular-weight control agent include, but are not limited to, monoamines (e.g., diethyl amine, dibutyl amine, butyl amine, and lauryl amine), and blocked amines (i.e., ketimine compounds) prepared by blocking the monoamines mentioned above.

The addition amount thereof is determined depending on the molecular weight desired for a produced urea-modified polyester.

The mixing ratio of the isocyanate group to the amine, i.e., the equivalent ratio ([NCO]/[NHx]) (x is 1 or 2) of the isocyanate group [NCO] contained in the prepolymer to the amino group [NHx] contained in the amine, is normally from 1/2 to 2/1, preferably from 1.5/1 to 1/1.5 and more preferably from 1.2/1 to 1/1.2.

Coloring Agent

Suitable coloring agents (coloring material) for use in the toner of this embodiment include known dyes and pigments.

Specific examples thereof include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Faise Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone BlueFast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. The content of the coloring agent is from 1 to 15% by weight and preferably from 3 to 12% by weight based on the toner.

In this embodiment, the coloring agent can be used as a master batch pigment, which is prepared by combining a coloring agent with a resin.

Specific examples of the binder resins for use in manufacturing the master batch or the binder resins kneaded with the master batch include, but are not limited to, the polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylate resins, rosin, modified rosins, terpene resins, aliphatic or alicyclic hydrocarbon resins, aromatic petroleum resins, chlorinated paraffin, paraffin waxes, etc. These resins can be used alone or in combination.

Master Batch

In this embodiment, the coloring agent can be used as a master batch pigment, which is prepared by combining a coloring agent with a resin. This master batch is typically prepared by mixing and kneading a resin and a coloring agent for the master batch upon application of high shear stress thereto. In this case, an organic solvent can be used to boost the interaction of the coloring agent with the resin. In addition, flushing methods in which an aqueous paste including a coloring agent is mixed with a resin solution of an organic solvent to transfer the coloring agent to the resin solution and then the aqueous liquid and organic solvent are separated and removed can be preferably used because the resultant wet cake of the coloring agent can be used as it is without being dried. In this case, a high shear dispersion device such as a three-roll mill, etc. can be preferably used for kneading the mixture.

Releasing Agent

Optionally, a releasing agent such as wax is contained together with the binder resin and the coloring agent to manufacture the toner of this embodiment of the present invention.

Any known wax as the releasing agent can be contained in the method of manufacturing toner of the present invention. Specific examples of the waxes include, but are not limited to, polyolefin waxes such as polyethylene waxes and polypropylene waxes; long chain hydrocarbons such as paraffin wax, and SAZOL wax; and waxes including a carbonyl group.

Among these, preferable waxes are the waxes having a carbonyl group. Specific examples of the waxes including a carbonyl group include, but are not limited to, polyalkane acid esters such as carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters such as trimellitic acid tristearyl, and distearyl maleate; polyalkane acid amide such as ethylenediamine behebylamide; polyalkylamide such as trimellitic acid tristearylamide; dialkyl ketone such as distearyl ketone, etc. Among these materials, the polyalkane acid esters are preferable. The content of the wax in the toner is from 0 to 40% by weight and preferably from 3 to 30% by weight based on the toner.

The melting point of the wax in the present invention is from 40 to 160° C., preferably from 50 to 120° C. and more preferably from 60 to 90° C. Wax having an excessively low melting point tends to have an adverse impact on the high temperature preservation property, and wax having an excessively high melting point tends to cause cold offset during fixing at a low temperature. The melt viscosity of the wax is preferably from 5 to 1,000 cps and more preferably from 10 to 100 cps measured at a temperature 20° C. higher than the melting point of the wax. A wax having an excessively high melt viscosity scarcely improves anti-hot offset property or low temperature fixing property.

Aqueous Medium

Suitable aqueous media for use in this embodiment include water, and a mixture of water with a solvent miscible with water.

Specific examples of such miscible solvent include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

Charge Controlling Agent

The toner of this embodiment optionally contains a charge controlling agent.

Specific examples of the charge controlling agent include, but are not limited to, known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc.

Specific examples of the marketed products of the charge controlling agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

In this embodiment, the content of the charge controlling agent is not unambiguously limited but determined depending on the kind of the binder resin, existence of optional external additives, and the method of manufacturing toner including a dispersion method. However, a preferable content of the charge controlling agent is from 0.1 to 10 parts by weight, and preferably from 0.2 to 5 parts by weight based on 100 parts of the binder resin.

A content that is excessively large tends to lead to excessive charging property to the toner, which results in a decrease in the effect of the charge controlling agent, an increase in an electrostatic attraction force between a development roller and the toner, reduction of the fluidity of the development agent (toner), and a decrease in the image density. These charge controlling agent can be melted and dispersed after melted and kneaded with the master batch and the resin, directly added to an organic solvent before dispersion and dissolution, or fixed on the surface of formed toner particles.

External Additive

An external additive can be added to the toner of this embodiment to help improving the fluidity, developability, chargeability thereof. Inorganic particulates are suitably used as such an external additive.

The inorganic particulate preferably has a primary particle diameter of from 5 nm to 2 μm, and more preferably from 5 nm to 500 nm. In addition, the specific surface area of the primary particle diameter of such inorganic particulates measured by the BET method is preferably from 20 to 500 $m^2/g$. The content ratio of such inorganic particulates is preferably from 0.01 to 5% by weight and particularly preferably from 0.01 to 2% by weight based on the weight of toner, Specific examples of the inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

In addition, polymer particulates, such as polystyrene, methacrylate copolymers and acrylate copolymers, which are obtained by a soap-free emulsification polymerization, a suspension polymerization, or a dispersion polymerization, and polycondensation thermocuring resin particles, such as silicone, benzoguanamine and nylon, can be also used as the external additives.

The external additives such as a fluidizer can be surface-treated to improve the hydrophobic property and prevent deterioration of the fluidity characteristics and chargeability in a high humidity environment.

Preferred specific examples of surface treatment agents include, but are not limited to, silane coupling agents, silyl agents, silane coupling agents having a fluorine alkyl group, organic titanate coupling agents, aluminum-based coupling agents, silicone oil, and modified-silicone oil.

As a cleaning property improver to remove a development agent remaining on an image bearing member or a primary transfer medium after transfer, stearic acid, aliphatic metal salts, for example, zinc stearate and calcium stearate, and polymer particulates manufactured by soap-free emulsification polymerization, such as polymethyl methacrylate particulates and polystyrene particulates, can be used. Such polymer particulates preferably have a relatively sharp particle size distribution and a volume average particle diameter of from 0.01 to 1 μm.

Process of Manufacturing Coarse Toner

The process of manufacturing coarse toner in this embodiment is specified in detail.

The method of manufacturing coarse toner of the present invention is not limited thereto.

Preparation of Polyester Resin

A polyester resin is obtained by heating a polyol (PO) and a polycarboxylic acid (PC) under the presence of a known esterification catalyst such as tetrabuthoxy titanate, dibutyltin oxide to 150 to 280° C. and removing water by evaporation under a reduced pressure, if necessary.

Preparation of Prepolymer

A polyester having an hydroxyl group prepared in the same manner as in the polyester specified above is reacted with a polyisocyanate (PIC) at 40 to 140° C. to obtain a polyester prepolymer (A) having an isocyanate group. A solvent is optionally used to conduct reaction of polyisocyanate (PIC). Specific examples of such solvents include, but are not limited to, the following inert with isocyanate compounds; aromatic solvents (toluene, xylene, etc.); ketones (acetone, methylethyl ketone, methylisobutylketone, etc.), esters (ethyl acetate); amides (dimethylformamide, dimethylacetoamide, etc.); and ethers (tetrahydrofurans, etc.).

Preparation of Modified Polyester Resin

The reaction between the polyester prepolymer (A) and the amine (B) can be conducted preliminarily or while being mixed with other toner composition material.

When the reaction is conducted preliminarily, the amine (B) is reacted with the polyester prepolymer (A) at 0 to 140° C. to obtain a urea modified polyester resin. A solvent can be optionally used to react the polyester prepolymer (A) and the amine (B) as in the case of preparation of the polyester prepolymer (A). The usable solvents are the same as specified above.

Process of Manufacturing Coarse Toner in Aqueous Medium

Suitable aqueous media for use in this embodiment include water, and a mixture of water with a solvent miscible with water.

Specific examples of such miscible solvents include, but are not limited to, alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

Toner particles are formed by reacting dispersion bodies formed of a polyester prepolymer (A) having an isocyanate group with an amine (B) in an aqueous medium or using a preliminarily manufactured modified polyester resin.

In a method of stably forming a dispersion body formed of a polyester resin and a polyester prepolymer (A) in an aqueous medium, toner composition material containing a polyester resin and a polyester prepolymer (A) is added in an aqueous medium followed by dispersion by mechanical shearing force. Other toner composition material such as wax and, a charge controlling agent can be mixed when the dispersion body is formed in an aqueous medium. However, it is more preferable that all the toner composition material be preliminarily mixed and then the mixture be introduced into the aqueous medium for dispersion. In this embodiment, the other toner composition material such as wax and a charge controlling agent is mixed (added) when or after particles are formed in an aqueous medium.

Addition of Solid Particulate Dispersion Agent

In addition, oil droplets are uniformly dispersed in an aqueous medium by preliminarily adding solid particulates dispersion agent in the aqueous medium.

The oil droplets are uniformly dispersed because the solid particulate dispersion agent is arranged on the surface of the oil droplets during dispersion, thereby preventing unification of the oil droplets. Therefore, a toner having a sharp particle size distribution is obtained. Some of the solid particulate dispersion agents are present in a solid form (insoluble) in an aqueous medium and preferably inorganic particulates having an average particle diameter of from 0.01 to 1 μm.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sandlime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Specific examples of the inorganic particulates include, but are not limited to, tricalcium phosphate, calcium carbonate, colloidal titanium oxide, colloidal silica and hydroxyapatite.

Hydroxyapatite synthesized by reaction between sodium phosphate and calcium chloride in an aqueous medium under a basic condition is particularly preferable.

Emulsification Dispersion

Specific examples of the dispersion agents for emulsifying and dispersing an oil phase in which toner compositions are dispersed in an aqueous medium include, but are not limited to, anionic dispersion agents, for example, alkylbenzene sulfonic acid salts, α-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl)glycin, di(octylaminoethyle) glycin, and N-alkyl-N,N-dimethylammonium betaine.

An extremely small amount of a surface active agent having a fluoroalkyl group is effective as the dispersion agent.

Preferable specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl (C6-C8)-N-ethylamino}-1-propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl (C6-C10)sulfoneamidepropyltrimethylammonium salts, salts of perfluoroalkyl (C6-C10)-N-ethylsulfonyl glycin, monoperfluoroalkyl (C6-C16)ethylphosphates, etc.

Specific examples of the marketed products of such surface active agents having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surface active agents having a fluoroalkyl group include primary, secondary and tertiary aliphatic amino acids, aliphatic quaternary ammonium salts (for example, perfluoroalkyl (C6-C10) sulfoneamidepropyltrimethyl ammonium salts), benzalkonium salts, benzetonium chloride, pyridinium salts, and imidazolinium salts. Specific examples of commercially available products of these elements include SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

Liquid droplet dispersion can be stabilized in an aqueous medium by using a polymer protection colloid.

Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropylmethacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or a heterocyclic ring having a nitrogen atom (e.g., vinyl pyridine, vinyl pyrrolidone, vinyl imidazole and ethylene imine). In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protection colloid.

When compounds, for example, calcium phosphate, which are soluble in an acid or alkali, are used as a dispersion stabilizer, it is possible to dissolve the calcium phosphate by adding an acid, for example, hydrochloric acid, followed by washing of the resultant particles with water, to remove the calcium phosphate from the particulates. In addition, a zymolytic method can be used to remove such compounds. Such a dispersion agent may remain on the surface of toner particles. However, the dispersion agent is preferably washed and removed after elongation and/or cross-linking reaction in terms of the charging property of toner particles.

Reaction Time

The reaction time required for the elongation and/or cross-linking reaction is determined depending on the reactivity according to the combination of the isocyanate group structure included in a polyester prepolymer (A) and the reactivity thereof with the added amine (B) and is typically from 10 minute to 40 hours and preferably from 2 to 24 hours. The reaction temperature is from 0 to 150° C. and preferably from 40 to 98° C.

Reaction Catalyst

Any known catalyst can be optionally used in the elongation reaction and/or cross linking reaction. Specific examples thereof include, but are not limited to, dibutyltin laurate, and dioctyltin laurate.

Removal of Organic Solvent

To remove the organic solvent from the obtained emulsification dispersion body, a method can be employed in which the entire system is gradually heated to completely evaporate and remove the organic solvent in droplets. Alternatively, a drying method can be used in which the dispersion body is sprayed in a dry atmosphere to completely evaporate and remove not only the non-water soluble organic solvent in droplets to form toner mother particles but also the remaining aqueous dispersion agent. The dry atmosphere can be prepared by heating gases, for example, air, nitrogen, carbon dioxide and combustion gases. The temperature of the heated gases is preferred to be higher than the boiling point of the solvent having the highest boiling point among the solvents used in the dispersion. A drying treatment that secures the quality can be completed in a short period of time by using a drying apparatus such as a spray dryer, a belt dryer or a rotary kiln.

Mixture with Other Kinds of Particles

The thus prepared coarse toner powder obtained after the drying process can be mixed with other particles of a charge control agent, a fluidizing agent, a coloring agent, etc. Such other particles can be fixed to the toner particles by applying a mechanical impact thereto to integrate the particles into the toner particles. Thus, the other particles can be prevented from being detached from the complex particles. Specific examples of such mechanical impact application methods include, but are not limited to, methods in which a mixture is mixed by a blade rotating at a high speed and methods in which a mixture is put into a jet air to accelerate and collide the particles against each other or a collision plate. Specific examples of such mechanical impact applicators (mixer) include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

Magnetizing Toner

The toner of the present invention can be used as a magnetic toner containing magnetic material. Specific examples of the magnetic material include, but are not limited to, oxidized iron such as magnetite, hematite and ferrite, metals such as iron, cobalt and nickel, or an alloyed metal thereof with aluminum, cobalt, copper, lead, magnesium, tin, zinc, antimony, beryllium, bismuth, cadmium, calcium, manganese, selenium, titanium, tungsten and vanadium, and a mixture thereof. Among these, magnetite is preferred in terms of magnetic characteristics. These electromagnetic materials preferably have an average particle diameter of from about 0.1 to about 2 μm. The content thereof is from about 15 to about 200 parts by weight and preferably from 20 to 100 parts by weight based on 100 parts by weight of the resin component.

Method of Screening Coarse Toner

The screening process conducted after an addition of external additives in which agglomerated bodies, coarse particles and foreign objects are removed from the coarse toner with a screen is described. FIG. 1 is a schematic diagram illustrating an example of the screening device employing a continuous screening system suitable for the method of manufacturing a toner of the present invention. In addition, FIG. 2 is a diagram illustrating the top screen of the screen device. The screening process in the present invention is described with reference to a screening device 1. This screening device 1 has two screens. One of them is a top screen 2 including a net 13 to which a vibration ring 11 that sympathetically vibrates to ultrasonic vibration by an ultrasonic oscillator 10 is provided as illustrated in FIG. 2. The ultrasonic oscillator 10 generates ultrasonic vibration according to ultrasonic signals generated by an ultrasonic generator 9 and vibrates the vibration ring (i.e., vibration device) 11 and finally the entire of the net 13. A net frame 12 and a reinforcing crosspiece 14 are provided to the top screen 2 to help sympathetic vibration of the vibration ring 11, thereby stably vibrating the top screen 2.

The opening of the net 13 is from 26 to 43 μm, and preferably designed according to the particle diameter of manufactured toner.

In addition, the vibration ring 11 is adjusted in terms of the size, weight, positioning, etc., to sympathetically vibrate to the vibration generated by the ultrasonic oscillator 10. By contrast, the ultrasonic vibration generated by the ultrasonic vibrator 10 can be adjusted according to the size, weight, positioning, etc. of the vibration ring.

The width of the amplitude of the net 13 vibrated by the ultrasonic oscillator 10 is preferably from 3 to 8 μm on one side amplitude.

A one side amplitude that is excessively small tends to reduce the advantage of this screening, which prevents efficient screening. By contrast, when the one side amplitude is too large, the net 13 tends to violently vibrate and thus the net 13 generates heat excessively, thereby softening coarse toner, and/or oozing the releasing agent and the binder resin therein to the surface of the toner particles. Therefore, the particles excessively agglomerate or attach to the net 13, thereby preventing screening.

The temperature of the net 13 of the top screen 2 is preferably 50° C. or lower, and more preferably 45° C. or lower to prevent excessive agglomeration of the toner particles and attachment thereof to the net 13. The temperature of the net 13 can be controlled within the limit by setting a small amplitude for the ultrasonic vibration, and/or suspending the screening on a regular interval to cool down the net 13. When the amplitude is set to be small, the efficiency of the screening can be increased by increasing the mechanical vibration. The top screen 2 adjusts the particle diameter of the toner by breaking up the agglomerated toner particles in addition to removal of foreign objects and coarse particles.

The top screen 2 screens coarse toner material introduced from a coarse toner mouth 4 provided on the top of the screening device 1 and a bottom screen 3 screens again the coarse toner that is almost classified by the top screen 2. However, the toner particles may be excessively heated when the toner particles are passing through the top screen 2 that is heated by the ultrasonic vibration, thereby softening the toner particles, or melting wax as the releasing agent, which leads to ooze of the wax to the surface of the toner particles. Then, the toner particles easily agglomerate and drop to the bottom screen 3 as agglomerated bodies. Alternatively, the toner particles may softly agglomerate on the bottom screen 3 after the toner particles have dropped thereon. The bottom screen 3 loosens and breaks up such softly agglomerated bodies to return them to original toner particles by mechanical vibration and cool down the toner particles while they are staying on the bottom screen 3. Thus, the toner particles hardly form agglomerated bodies and pass through the bottom screen 3. The screen 1 having a structure as illustrated in FIG. 1 includes a mechanical vibrator 8 driven by a vibration motor, which is situated on the bottom of the screen device 1. This mechanical vibrator 8 mechanically vibrates the top screen 2 and the bottom screen 3. The toner particles that have dropped from the top screen 2 are cooled down on the bottom screen 3 while mechanically vibrated thereon, which prevents agglomeration of wax and binder resin. To fully demonstrate such effects, the temperature of the bottom screen 3 is kept at 35° C. or lower, and preferably 30° C. or lower. The temperature of the bottom screen 3 is almost the same as the temperature of the toner particles passing therethrough. Therefore, the toner particles having a temperature of 35° C. or lower are likely to hardly agglomerate. Thus, the toner product can be preserved as they are without a concern for agglomeration unless the toner is exposed to a high temperature environment. The temperature of the bottom screen 3 can be controlled by adjusting the temperature of the top screen 2 and the screening speed of the toner particles in addition to the environment temperature.

The opening of the bottom screen is in the range of from 54 to 105 μm, which is greater (more coarse) than that of the top screen 2. The toner particles that have passed through the top screen 2 without agglomeration naturally pass through the bottom screen 3. When a screen having an excessively small opening is used as the bottom screen 3, the screening speed tends to decrease and thus the coarse toner may stay thereon. By contrast, when a screen having an excessively large opening is used as the bottom screen 3, softly agglomerated bodies tend to pass therethrough and commingle with toner product. In addition, the toner particles tend to pass through the bottom screen 3 at an excessively high speed. Thus, the toner particles may agglomerate because the toner particles are not sufficiently cooled down. The opening of the bottom screen 3 is preferably set to be small to make the stay time of the toner particles thereon long particularly when the temperature of the top screen 2 is high.

The toner particles that have passed through the bottom screen 3 are discharged from a toner product outlet 5. Coarse particles that have been trapped on the top screen 2 or the bottom screen 3 are discharged from a coarse particle outlet 6 or 7, respectively.

Carrier for Two Component Development Agent

The toner of the present invention can be used as a single component development agent such as magnetic or non-magnetic toner free from a carrier, or in a two component development agent which is a mixture of a magnetic carrier and the toner.

The weight ratio of the toner to the magnetic carrier is preferably from 1/100 to 10/100. Any known material can be used as the magnetic carrier. Specific examples thereof include, but are not limited to, powder having magnetic characteristics such as iron powder, ferrite powder and nickel powder, glass beads, and material the surface of which is treated with a resin, etc. For example, iron powder, ferrite powder and magnetite powder, and magnetic resin carrier having a particle diameter of from about 20 to about 200 μm can be used. Magnetic carrier can be covered by coating material.

Specific examples of the resin powder that can be used for coating the magnetic carrier include, but are not limited to, amino resins, for example, urea-formaldehyde resins, melamine resins, benzoguanamine resins, urea resins, and polyamide resins, and epoxy resins. Other specific examples include, but are not limited to, polyvinyl or polyvinylidene resins, for example, acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins, for example, polyvinyl chloride resins, polyester resins, for example, polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, fluoroterpolymers, for example, a copolymer of tetrafluoroethylene, fluorovinylidene and other monomers including no fluorine atom, silicone resins, maleic acid resins, fluorine based resins, and epoxy resins. In the case of a styrene-acryl copolymer, it is preferable to contain styrene of from 30 to 90% by weight. When the content of styrene is too small, the development characteristics easily degrade. By contrast, a content of styrene that is too large tends to harden the coated film so that the coated film is easily peeled off, which shortens the working life of the carrier.

Electroconductive powder, etc., can be optionally contained in the coating resin as the coating material. Specific examples of such electroconductive powder include, but are not limited to, metal powder, carbon blacks, titanium oxide, tin oxide, and zinc oxide. The average particle diameter of such electroconductive powder is preferably not greater than 1 μm. When the average particle diameter is within this range, the electric resistance can be suitably controlled. Having generally described preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Manufacturing Coarse Toner

Material for an oil phase such as an unmodified polyester, a prepolymer, a master batch (MB), and ketimine are prepared and the oil phase and an aqueous phase are prescribed from the material. Emulsified liquid dispersion is obtained by mixing the oil phase and the aqueous phase using a mixer having an emulsification mechanism. The emulsified liquid dispersion is subject to removal of solvent, filtration, washing, and drying to obtain mother toner particles. The mother toner particles are screened to obtain toner. Each process is described below.

Synthesis of Non-modified Polyester B 690 parts of an adduct of bisphenol A with 2 mol of ethylene oxide and 256 parts of terephthalic acid are placed in a reaction container equipped with a condenser, a stirrer and a nitrogen introduction tube to conduct reaction at 230° C. for 8 hours. Next, the reaction is continued for 5 hours with a reduced pressure of 10 to 15 mmHg (1.3 to 2.0 Pa). Subsequent to cooling down to 160° C., 18 parts of phthalic anhydride is added for reaction for 2 hours to obtain [Non-modified polyester B].

Synthesis of Prepolymer A

The following components are placed in a container equipped with a condenser, a stirrer and a nitrogen introducing tube to conduct reaction at 230° C. at normal pressure for 8 hours followed by another reaction for 5 hours with a reduced pressure of 10 to 15 mmHg (1.3 to 2.0 Pa). Subsequent to cooling down to 160° C., 32 parts of phthalic anhydride is added for reaction for 2 hours.

| | |
|---|---|
| Adduct of bisphenol A with 2 mole of ethylene oxide: | 682 parts |
| Adduct of bisphenol A with 2 mole of propylene oxide: | 81 parts |
| Terephthalic acid: | 283 parts |
| Trimellitic anhydride: | 22 parts |
| Dibutyl tin oxide: | 2 parts |

Subsequent to cooling down to 80° C., 230 parts of isophorone diisocyanate is added to the reaction liquid and a 2 hour reaction is conducted in ethyl acetate to obtain [Prepolymer A] containing an isocyanate group.

Synthesis of Ketimine Compound 1

In a reaction container equipped with a stirrer and a thermometer, 170 parts of isophoronediamine and 75 parts of methyl ethyl ketone are mixed to conduct reaction at 50° C. for 5 hours to obtain [Ketimine compound 1]. Manufacturing of Toner Material Solution 14.3 parts of [Prepolymer A], 55 parts of [Non-modified polyester B], and 78.6 parts of ethyl acetate are set in a tank followed by stirring for dissolution. Thereafter, 10 parts of rice wax (releasing agent: melting point: 83° C.) and 4 parts of copper phthalocyanine blue pigment is added. The solution is stirred at 60° C. by a TK HOMOMIXER at 12,000 rpm for 15 minutes followed by dispersion treatment by a bead mill at 20° C. for 60 minutes. This is determined as [Toner material solution 1].

Manufacturing of Mother Particle A

The following is place in another tank to dissolve them uniformly.

| | |
|---|---|
| Deionized water | 306 parts |
| 10% suspension of calcium triphosphate | 265 parts |
| Dodecylbenzene sodium sulfate | 0.2 parts |

Then, 749 parts of [Toner material solution 1] and 2.7 parts of [Ketimine compound 1] are added thereto to conduct urea reaction while the solution is stirred at 12,000 rpm by a TK HOMOMIXER. The particle diameter and the particle size distribution are observed by an optical microscope. When the average particle diameter is greater than about 10 μm, stirring is continued for 5 more minutes at a number of stirring rotation of 14,000 rpm to obtain a liquid emulsification. Thereafter, the liquid emulsification is heated to 45° to remove the solvent by stirring at 10.5 m/s for the outer peripheral speed under the atmospheric pressure (101.3 kPa) for 5 hours. Thereafter, the resultant is subsequently subject to treatment of filtration, washing and drying to obtain [Mother toner particle A].

Manufacturing of Coarse Toner A 1.0 parts of hydrophobic silica and 100 parts of the thus obtained mother particle are placed in a super mixer (manufactured by Kawata Mfg. Co., Ltd). The super mixer is operated at 1,100 rpm for 60 seconds followed by an intermission of 60 seconds and 1,300 rpm for 120 seconds followed by an intermission of 60 seconds. Then, 0.7 parts of hydrophobic titanium oxide is introduced to the super mixer and mixed at 1,100 rpm and 1,300 rpm with intermissions in the same manner as described above. Again, 1.0 part of hydrophobic titanium oxide is introduced and mixed at 1,000 rpm for 60 seconds followed by an intermission of 60 seconds and 1,100 rpm for 60 seconds followed by an intermission of 60 seconds to obtain [Coarse toner A].

Screening Process (Manufacturing of Toner A1)

Thereafter, the coarse toner A is screened by a circular vibrating screen (manufactured by KOWA KOGYOSHO CO., LTD.) (same screen as the screen device schematically illustrated in FIG. 1 except that a vibration ring is provided to the bottom screen as well as the top screen). [Coarse toner A] is mechanically and ultrasonically vibrated at the top screen having an opening of 34 μm with a one side amplitude of 8 μm and just mechanically vibrated at the bottom screen having an opening of 104 μm for 5 hours in total to obtain [Toner A1].

The temperature of the vibration ring of the top screen (equal to the temperature of the top screen), the toner remaining on the bottom screen, the vibration ring of the bottom screen (equal to the temperature of the bottom screen), and [Toner A1] collected at an outlet of the screening device as a product are measured by a contact type thermometer (testo 925, manufactured by Testo Inc.). The results are shown in Table 1. The toner remaining on the bottom screen and [Toner A1] have almost the same temperature and thus the temperature of the toner remaining on the bottom screen is omitted in Table 1.

Evaluation on Toner A1

50 g of [Toner A1] obtained after the screening process is screened with a sieve having 200 meshes (linear diameter: 50 μm, opening: 75 μm). The toner (softly agglomerated toner particles) remaining on the sieve is measured by an electronic balance (AUW120D, manufactured by Shimadzu Corporation). The ratio of the softly agglomerated toner to [Toner A1] is 0.045 mg/g. The results are shown in Table 1.

A two component development agent having a toner density of 7% is manufactured by the obtained [Toner A1] and a carrier and filled in an image forming apparatus (imagio MP C5000, manufactured by Ricoh Co., Ltd.) to conduct an image formation test. A halftone solid image is formed on two A3 sheets and evaluated by the number of white spots (abnormal image portions). No white spots are observed in the image evaluation on an image formed by using this two component development agent. The evaluation results on images are shown in Table 1.

TABLE 1

| | Top Screen | | | Bottom Screen | | | Evaluation | |
|---|---|---|---|---|---|---|---|---|
| | Opening (μm) | US vib. (μm) | Temp. of Vib. ring | Opening (μm) | Temp. of Vib. ring | Temp. of toner after screen | Amt of agg. Body (mg/g) | # of white spots |
| Ex. 1 | 34 | 8 | 36.4 | 104 | 26.0 | 28.7 | 0.045 | 0 |
| Ex. 2 | 26 | 8 | 37.7 | 104 | 26.2 | 30.6 | 0.060 | 0 |
| Ex. 3 | 43 | 8 | 36.1 | 150 | 26.1 | 28.0 | 0.030 | 0 |
| Ex. 4 | 34 | 3 | 30.6 | 150 | 26.1 | 26.9 | 0.024 | 0 |
| Ex. 5 | 34 | 8 | 36.7 | 54 | 26.3 | 28.8 | 0.036 | 0 |
| Ex. 6 | 26 | 3 | 32.2 | 54 | 26.1 | 28.3 | 0.040 | 0 |
| Ex. 7 | 34 | 8 | 36.0 | 104 | 26.4 | 27.8 | 0.055 | 0 |
| Ex. 8 | 34 | 37 | 37.0 | 104 | 26.2 | 29.1 | 0.048 | 0 |
| Ex. 9 | 34 | 8 | 36.8 | 104 | 26.3 | 30.6 | 0.011 | 0 |
| Comp. 1 | 34 | 8 | 36.5 | 104 | 37.0 | 33.4 | 5.403 | 15 |
| Comp. 2 | 34 | 8 | 36.2 | 198 | 26.3 | 28.3 | 0.934 | 4 |
| Comp. 3 | 34 | — | — | 104 | — | — | — | — |
| Comp. 4 | 54 | 8 | — | 104 | — | — | — | — |
| Comp. 5 | 34 | 10 | 57.1 | 150 | — | — | — | — |
| Comp. 6 | 20 | 8 | — | 150 | — | — | — | — |
| Comp. 7 | 34 | 3 | 30.9 | 45 | 26.0 | — | — | — |
| Comp. 8 | 34 | 8 | 36.7 | No bottom screen | | | 2.100 | 7 |
| Comp. 9 | 34 | 8 | 36.2 | 104 | 36.5 | 33.0 | 4.523 | 10 |
| Comp. 10 | 34 | 8 | 35.8 | 198 | 26.2 | 27.9 | 0.675 | 3 |
| Comp. 11 | 34 | 5 | 36.5 | No bottom screen | | | 1.805 | 6 |
| Comp. 12 | 34 | 8 | 36.5 | 104 | 36.7 | 33.6 | 8.874 | 20 |
| Comp. 13 | 34 | 8 | 36.1 | 104 | 36.7 | 32.8 | 6.675 | 17 |

Example 2

[Toner A2] is manufactured in the same manner as in Example 1 except that the opening of the top screen is changed from 34 to 26 μm in the screening process. The thus obtained [Toner A2] is evaluated in the same manner as in Example 1. As a result, the ratio of the softly agglomerated toner particles in [Toner A2] is 0.060 mg/g and no white spots are observed in the image evaluation. The evaluation results on [Toner A2] are shown in Table 1 with the conditions of openings of the screens in the screening process as in Example 1.

Example 3

[Toner A3] is manufactured in the same manner as in Example 1 except that the opening of the top screen is changed from 34 to 43 μm and the opening of the bottom screen is changed from 104 to 150 μm in the screening process. The thus obtained [Toner A3] is evaluated in the same manner as in Example 1. As a result, the ratio of the softly agglomerated toner particles in [Toner A3] is 0.030 mg/g and no white spots are observed in the image evaluation. The evaluation results on [Toner A3] are shown in Table 1 with the conditions of openings of the screens in the screening process as in Example 1.

Example 4

[Toner A4] is manufactured in the same manner as in Example 1 except that the opening of the bottom screen is changed from 104 to 150 μm and the one side amplitude of the ultrasonic is changed from 8 to 3 μm in the screening process. The thus obtained [Toner A4] is evaluated in the same manner as in Example 1. As a result, the ratio of the softly agglomerated toner particles in [Toner A4] is 0.024 mg/g and no white spots are observed in the image evaluation. The evaluation results on [Toner A4] are shown in Table 1 with the conditions of openings of the screens in the screening process as in Example 1.

Example 5

[Toner A5] is manufactured in the same manner as in Example 1 except that the opening of the bottom screen is changed from 104 to 54 μm in the screening process. The thus obtained [Toner A5] is evaluated in the same manner as in Example 1. As a result, the ratio of the softly agglomerated toner particles in [Toner A5] is 0.036 mg/g and no white spots are observed in the image evaluation. The evaluation results on [Toner A5] are shown in Table 1 with the conditions of openings of the screens in the screening process as in Example 1.

Example 6

[Toner A6] is manufactured in the same manner as in Example 1 except that the opening of the top screen is changed from 34 to 26 μm, the opening of the bottom screen is changed from 104 to 54 μm and the one side amplitude of the ultrasonic is changed from 8 to 3 μm in the screening process. The thus obtained [Toner A6] is evaluated in the same manner as in Example 1.

As a result, the ratio of the softly agglomerated toner particles in [Toner A6] is 0.040 mg/g and no white spots are observed in the image evaluation. The evaluation results on [Toner A6] are shown in Table 1 with the conditions of openings of the screens in the screening process as in Example 1.

Example 7

Manufacturing of Mother Particle B

The following toner material is placed in a HENSCHEL MIXER (MF20C/I type, manufactured by Mitsui Miike Mining Co., Ltd.) and sufficiently stirred, and mixed, and kneaded with a two roll extruder (manufactured by Toshiba Machine Co., Ltd.) in such a manner that the temperature of the kneaded resultant mixture at the outlet of the extruder is around 120° to extrude the kneaded resultant mixture.

Polyester resin 1 (copolymer of fumaric acid, adipic acid, dodecenyl succinic acid, 1,4-butane diol, and 1,6-hexane diol):
15 parts Polyester resin 2 (copolymer of terephthalic acid, fumaric acid, trimellitic anhydride, ethylene glycol, propylene glycol, and

| | |
|---|---|
| neopentyl glycol): | 85 parts |
| Ester wax (melting point: 85° C.): | 5 parts |
| zirconium salicylate | 1 part |
| Disazo yellow pigment | 7 parts |

The obtained kneaded resultant mixture is cooled down and then pulverized and classified such that the weight average particle diameter (D4) is from 5.3 to 6.3 μm, and the ratio (D4/D1) of the weight average particle diameter (D4) to the number average particle diameter (D1) is from 1.2 to 1.3. Thus, [Mother toner particle B] is obtained.

Manufacturing of Coarse Toner B

[Coarse toner B] is obtained in the same manner as in Example 1 except that [Mother toner particle A] is replaced with [Mother toner particle B] in the process of manufacturing [Coarse toner A] of Example 1.

Screening Process (Manufacturing of Toner B1)

[Toner B1] is obtained in the same manner as in Example 1 except that [Coarse toner A] is replaced with [Coarse toner B] in the screening process of Example 1.

Evaluation on Toner B1

[Toner B1] is evaluated in the same manner as in Example 1 except that [Toner A1] is replaced with [Toner B1] in the evaluation of [Toner A1] of Example 1. As a result, the ratio of the softly agglomerated toner particles in [Toner B1] is 0.055 mg/g and no white spots are observed in the image evaluation. The evaluation results on [Toner B1] are shown in Table 1 with the conditions of openings of the screens in the screening process as in Example 1.

Example 8

Preservation of Toner A1

Toner A1 is packed in a 250 kg flexible container bag, and preserved in an environment in which the temperature is 40° C., and the humidity is 70% for 2 weeks to obtain [Toner A1 after preservation].

The ratio of agglomerated toner particles in [Toner A1 after preservation] is measured in the same manner as in Example 1.

As a result, the agglomerated toner particle in [Toner A1 after preservation] is 28.83 mg/g.

Manufacturing of Toner A8

[Toner A1 after preservation] is used instead of [Coarse toner A] as material and screened again in the same manner as in the screening process of Example 1. This screened [Toner A1 after preservation] is defined as [Toner A8].

Evaluation on Toner A8

[Toner A8] is evaluated in the same manner as in Example 1 except that [Toner A1] is replaced with [Toner A8] in the evaluation of [Toner A1] of Example 1. As a result, the ratio of the softly agglomerated toner particles in [Toner A8] is 0.048 mg/g and no white spots are observed in the image evaluation. The evaluation results on [Toner A8] are shown in Table 1 with the conditions of openings of the screens in the screening process as in Example 1.

Example 9

[Toner B1 after preservation] is prepared in the same manner as in Example 8 except that [Toner A1] is replaced with [Toner B1] in the preservation of [Toner A1] of Example 8.

The ratio of the agglomerated toner particle in [Toner B1 after preservation] is 30.6 mg/g.

[Toner B2] is manufactured from [Toner B1 after preservation] in the same manner as in manufacturing of Toner A8 of Example 8. [Toner B2] is evaluated in the same manner as in the evaluation of Toner A8. As a result, the ratio of the softly agglomerated toner particles in [Toner B2] is 0.011 mg/g and no white spots are observed in the image formation. The evaluation results on [Toner B2] are shown in Table 1 with the conditions of openings of the screens in the screening process as in Example 1.

Comparative Example 1

Manufacturing of Toner A11

An ultrasonic oscillator is attached to the vibration ring of the bottom screen of the screen device in the screening process of Example 1. [Toner A11] is manufactured in the same manner as in Example 1 except that the bottom screen is vibrated by ultrasonic having a one side amplitude of 8 μm in addition to the mechanical vibration.

Evaluation on Toner A11

Toner A11 is evaluated in the same manner as in Example 1. The ratio of the agglomerated toner particle in [Toner A11] is 5.4 mg/g.

Comparative Example 2

[Toner A12] is manufactured in the same manner as in Example 1 except that the opening of the bottom screen is changed from 104 to 198 μm in the screening process. The thus obtained [Toner A12] is evaluated in the same manner as in Example 1. The ratio of the agglomerated toner particle in [Toner A12] is 0.934 mg/g and the number of white spots is 4 in the image evaluation. The evaluation results on [Toner A12] are shown in Table 1 with the conditions of openings of the screens in the screening process as in Example 1.

Comparative Example 3

Manufacturing of [Toner A13] is attempted in the same manner as in Example 1 except that ultrasonic vibration to the top screen is not conducted in the screening process. However, [Coarse toner A] accumulates on the top screen and overflows therefrom so that toner product is hardly obtained and thus manufacturing [Toner A13] is abandoned.

Comparative Example 4

Manufacturing of [Toner A14] is attempted in the same manner as in Example 1 except that the opening of the top screen is changed from 34 to 54 μm. However, [Coarse toner A] just passes through the top screen and accumulates on the bottom screen and overflows therefrom so that toner product is hardly obtained and thus manufacturing [Toner A14] is abandoned.

Comparative Example 5

Manufacturing of [Toner A15] is attempted in the same manner as in Example 1 except that the one side amplitude of ultrasonic vibration of the top screen is changed from 8 to 10 μm and the opening of the bottom screen is changed from 104 to 150 μm. However, the temperature of the top screen rises and [Coarse toner A] is melted and attached to the top screen in 2 hours so that toner product is hardly obtained and thus manufacturing [Toner A15] is abandoned.

Comparative Example 6

Manufacturing of [Toner A16] is attempted in the same manner as in Example 1 except that the opening of the top screen is changed from 34 to 20 μm. However, [Coarse toner A] accumulates on the top screen and overflows therefrom so that toner product is hardly obtained and thus manufacturing [Toner A16] is abandoned.

Comparative Example 7

Manufacturing of [Toner A17] is attempted in the same manner as in Example 1 except that the one side amplitude of ultrasonic vibration of the top screen is changed from 8 to 3 μm and the opening of the bottom screen is changed from 104 to 45 μm. However, [Coarse toner A] accumulates on the bottom screen and overflows from the top of the bottom screen so that toner product is hardly obtained and thus manufacturing [Toner A17] is abandoned.

Comparative Example 8

[Toner A18] is manufactured in the same manner as in Example 1 except that the bottom screen is removed in the screening process. The thus obtained [Toner A18] is evaluated in the same manner as in Example 1. As a result, the ratio of the agglomerated toner particle in [Toner A18] is 2.100 mg/g and the number of white spots is 7 in the image evaluation. The evaluation results on [Toner A18] are shown in Table 1 with the conditions of openings of the screens in the screening process as in Example 1.

Comparative Example 9

[Toner A19] is manufactured in the same manner as in Comparative Example 1 except that [Toner A1] is replaced with [Toner B1] and thus obtained [Toner A19] is evaluated in the same manner as in Example 1.

As a result, the ratio of the agglomerated toner particle in [Toner A19] is 4.523 mg/g and the number of white spots is 7 in the image evaluation. The evaluation results on [Toner A19] are shown in Table 1 with the conditions of openings of the screens in the screening process as in Comparative Example 1.

Comparative Example 10

[Toner A20] is manufactured in the same manner as in Comparative Example 2 except that [Toner A1] is replaced with [Toner B1] and thus obtained [Toner A20] is evaluated in the same manner as in Comparative Example 1. As a result, the ratio of the agglomerated toner particle in [Toner A20] is 0.675 mg/g and the number of white spots is 3 in the image evaluation. The evaluation results on [Toner A20] are shown in Table 1 with the conditions of openings of the screens in the screening process as in Comparative Example 1.

Comparative Example 11

[Toner A21] is manufactured in the same manner as in Comparative Example 8 except that [Toner A1] is replaced with [Toner B1] and thus obtained [Toner A21] is evaluated in the same manner as in Comparative Example 8. As a result, the ratio of the agglomerated toner particle in [Toner A21] is 1.805 mg/g and the number of white spots is 6 in the image evaluation. The evaluation results on [Toner A21] are shown in Table 1 with the conditions of openings of the screens in the screening process as in Comparative Example 8.

Comparative Example 12

[Toner A22] is manufactured in the same manner as in Comparative Example 1 except that [Toner A1] is replaced with [Toner A1 after preservation] manufactured in Example 8 and thus obtained [Toner A22] is evaluated in the same manner as in Comparative Example 1. As a result, the ratio of the agglomerated toner particle in [Toner A22] is 8.874 mg/g and the number of white spots is 20 in the image evaluation. The evaluation results on [Toner A22] are shown in Table 1 with the conditions of openings of the screens in the screening process as in Comparative Example 1.

Comparative Example 13

[Toner A23] is manufactured in the same manner as in Comparative Example 1 except that [Toner A1] is replaced with [Toner B1 after preservation] manufactured in Example 9 and thus obtained [Toner A23] is evaluated in the same manner as in Comparative Example 1. As a result, the ratio of the agglomerated toner particle in [Toner A23] is 6.675 mg/g and the number of white spots is 17 in the image evaluation. The evaluation results on [Toner A23] are shown in Table 1 with the conditions of openings of the screens in the screening process as in Comparative Example 1.

Analysis on Result

According to the method of manufacturing toner of the present invention, agglomerated bodies in coarse toner are broken up by the top screen and toner particles that are made to be softly or easily agglomerated by the heat generated by ultrasonic vibration are broken up by the bottom screen while being cooled down thereon to obtain toner products. The productivity of manufacturing products increases and toner having stable quality can be manufactured by adjusting the opening of the top screen and the bottom screen and applying ultrasonic vibration to the top screen. Furthermore, quality toner can be efficiently manufactured more efficiently by controlling the amplitude of ultrasonic vibration and the temperatures of the top screen and the bottom screen.

In addition, toner that has agglomerated due to the condition of preservation environment can be recycled by using the screen device for use in the present invention.

This document claims priority and contains subject matter related to Japanese Patent Application No. 2008-293677, filed on Nov. 17, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing a toner comprising:

manufacturing a coarse toner comprising a binder resin and a coloring agent; and screening the coarse toner with a screen device comprising (i) a top screen having an opening in a range of 26 to 43

μm and (ii) a bottom screen situated below, and separated from, the top screen and having an opening in a range of 54 to 150 μm, to screen the coarse toner with the top screen by ultrasonic vibration and mechanical vibration at 50° C. or lower, and with the bottom screen by mechanical vibration at 35° C. or lower.

2. The method of manufacturing a toner according to claim 1, wherein the top screen comprises a sympathetic vibrator that sympathetically vibrates to the ultrasonic vibration.

3. A method of recycling a toner comprising:

screening the toner comprising a binder resin, and a coloring agent with a screen device comprising (i) a top screen having an opening in a range of 26 to 43 μm and (ii) a bottom screen situated below, and separated from, the top screen and having an opening in a range of 54 to 150 μm, to screen the toner with the top screen by ultrasonic vibration and mechanical vibration, and the toner screened by the top screen with the bottom screen by mechanical vibration.

4. The method of recycling a toner according to claim 3, wherein the top screen has a sympathetic vibrator that sympathetically vibrates to the ultrasonic vibration.

5. The method of recycling a toner according to claim 3, wherein the top screen screens the toner at 50° C. or lower, and the bottom screen screens the toner at 35° C. or lower.

6. The method of recycling a toner according to claim 3, wherein a one side amplitude in the ultrasonic vibration is from 3 to 8 μm.

7. The method of manufacturing a toner according to claim 1, wherein the top screen and the bottom screen are disposed such that the top screen and the bottom screen maintain a non-zero distance therebetween during the ultrasonic and mechanical vibrations.

8. The method of manufacturing a toner according to claim 1, wherein the coarse toner passing through the top screen is cooled down by air while staying on the bottom screen.

* * * * *